US007096836B2

(12) United States Patent
Curtis

(10) Patent No.: US 7,096,836 B2
(45) Date of Patent: Aug. 29, 2006

(54) ADJUSTABLE ROCKER ARM ASSEMBLY FOR EASING VALVE LASH ADJUSTMENT

(76) Inventor: William P. Curtis, 171 N. Ruse, Mundelein, IL (US) 60060

( * ) Notice: Subject to any disclaimer, the term of this patent is extended or adjusted under 35 U.S.C. 154(b) by 0 days.

(21) Appl. No.: 11/111,132

(22) Filed: Apr. 21, 2005

(65) Prior Publication Data

US 2005/0199205 A1 Sep. 15, 2005

Related U.S. Application Data

(63) Continuation-in-part of application No. 10/742,146, filed on Dec. 22, 2003, now abandoned.

(51) Int. Cl.
*F01L 1/18* (2006.01)

(52) U.S. Cl. ..... 123/90.43; 123/90.41; 123/90.39; 123/90.16

(58) Field of Classification Search ..... 123/90.16, 123/90.41, 90.39, 90.43, 90.33
See application file for complete search history.

(56) References Cited

U.S. PATENT DOCUMENTS 4,561,392 A * 12/1985 Jette ..... 123/90.43
5,645,025 A 7/1997 Caya et al.

* cited by examiner

*Primary Examiner*—Thomas Denion

*Assistant Examiner*—Zelalem Eshete

(57) ABSTRACT

A tubular mount system for a rocker arm which includes a rigid clamp at the base of the engine head is disclosed. Included is a pedestal mount/adjuster with external threads engageable with internal threads of a trunnion assembly cooperatively associated with a rocker arm whereby the rocker arm can be raised or lowered by turning the pedestal mount/adjuster, rotatably received by a rocker stud. This eliminates the need for an adjuster stud and nut on the rocker arm and a pillow block to hold the device together.

20 Claims, 5 Drawing Sheets

FIG 3(a)
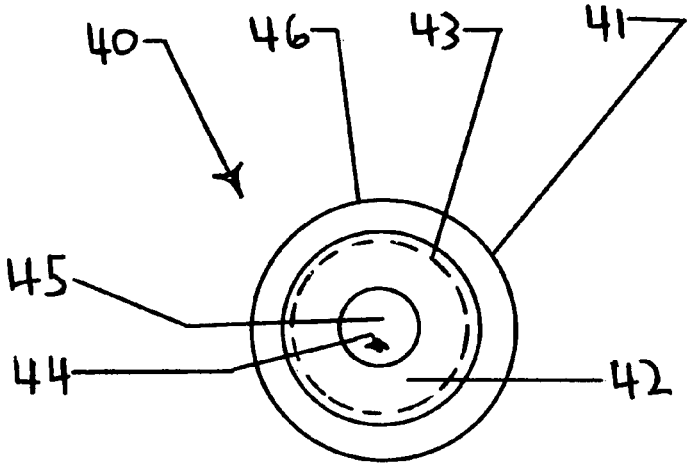
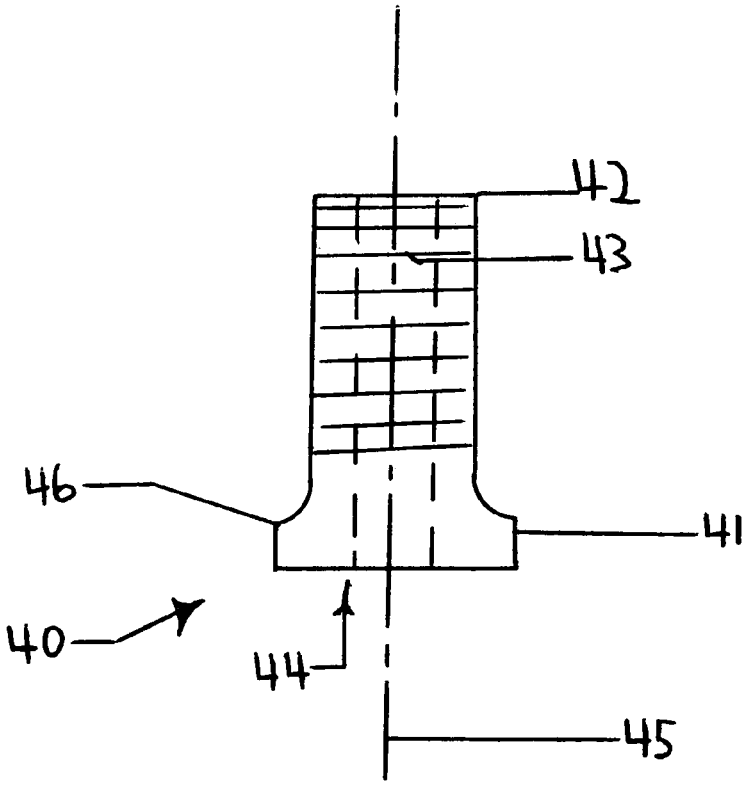
FIG 3(b)

FIG 4(a)
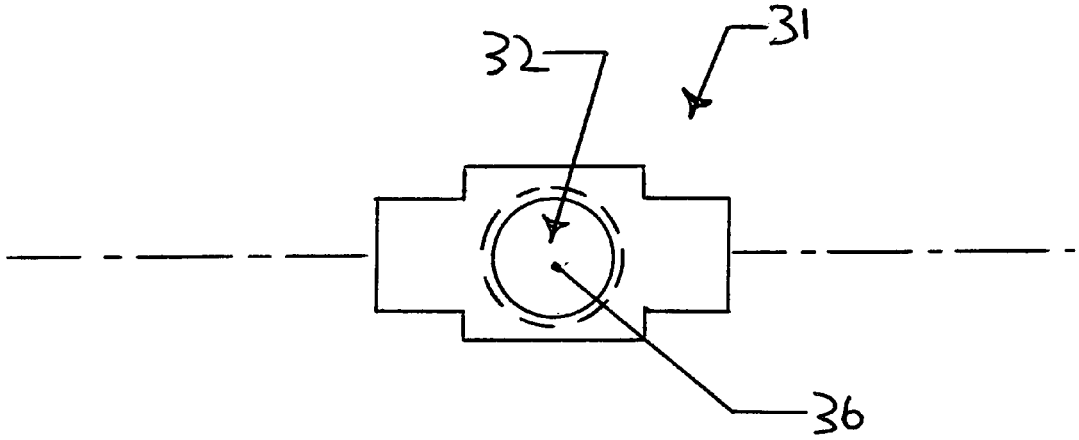
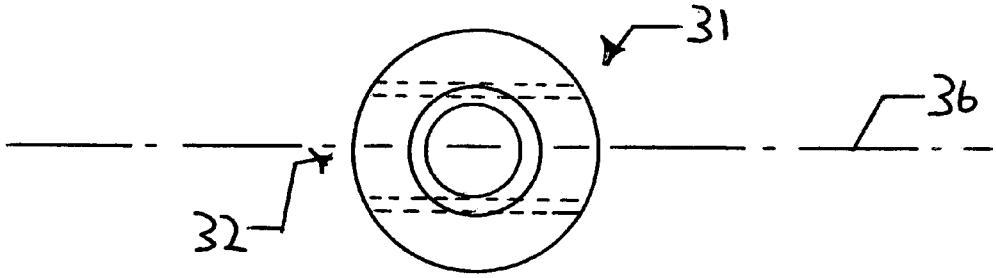
FIG 4(b)

FIG 5
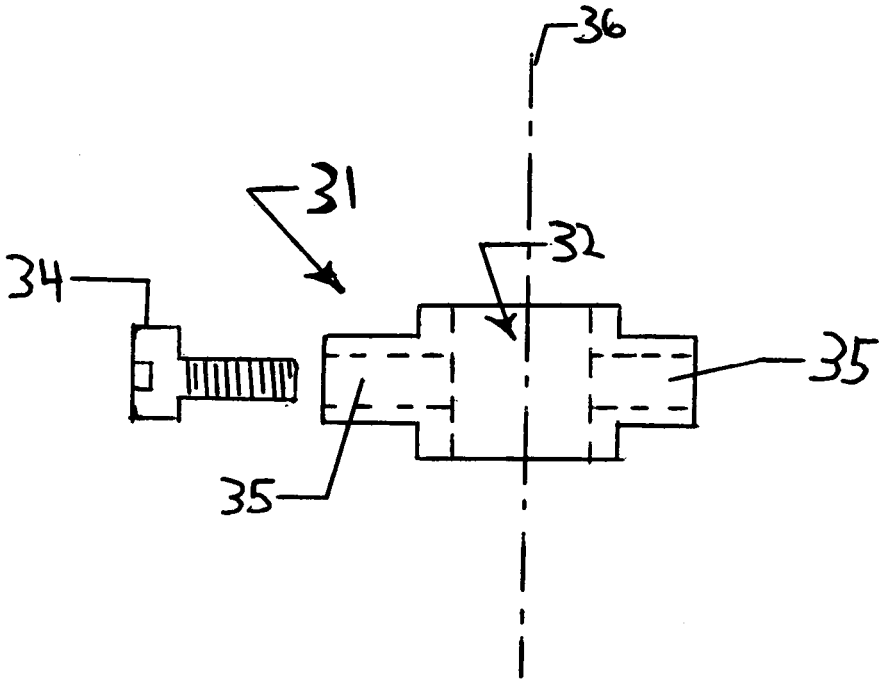
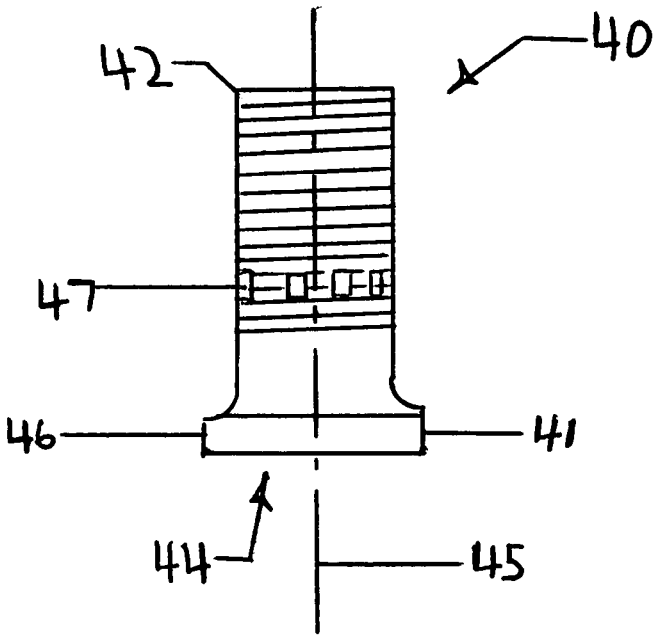
FIG 6

ADJUSTABLE ROCKER ARM ASSEMBLY FOR EASING VALVE LASH ADJUSTMENT

PRIOR HISTORY

This application is a continuation-in-part patent application claiming priority to U.S. patent application Ser. No. 10/742,146, filed in the United States Patent and Trademark Office on Dec. 22, 2003 now abandoned.

BACKGROUND OF THE INVENTION

1. Field of the Invention

The present invention generally relates to a rocker arm assembly. More particularly, the present invention relates to a rocker arm assembly for enabling engine technicians to more quickly and efficiently make valve lash adjustment.

2. Description of the Prior Art

A normal maintenance item for most engines is valve adjustment. Also known as setting "valve clearance" or "valve lash," this adjustment is an important maintenance item to insure lengthy, proper, and efficient operation of a four stroke engine. The valves in a four stroke engine open and close to allow intake air to flow into and exhaust gases to flow out of the engine. Often times a rocker/follower rides on the cam lobe (with the crankshaft and timing belt/chain turning the cams) and the rocker/follower thus actuates the valves. The cam has a "lump" for lift and a "base circle" for the duration of the engine rotation where the valve is closed. In order to insure that the valves close completely the "valve clearance" or "valve lash" is set so that there is a known clearance between the valves and the rocker arm.

The valve adjustment is important for two reasons. One, if the valves do not close properly, the engine can lose a substantial amount of power since the intake mixture will be "squeezed out" during the compression cycle (hence less mixture burned, less energy resulting from combustion). This might also result in burned valves as the exhaust valves depend partly on contact with the valve seat (head) for cooling. Second, if the valves do not open all the way, the engine will receive poor flow through the head (less mixture) and again lose power.

As the engine ages and more miles are put on it, the valve clearance can change. Repeated thermal cycling of the mechanism as well as mechanical wear will alter the adjustment slightly, resulting (typically) in increased clearance. This increase in clearance is usually characterized by an increased "ticking" at idle. Depending on the motor and the methodology, one may set this adjustment by measuring the clearance between the valve and rocker or the rocker and the cam. It will thus be understood that valve lash adjustment is required with respect to engine rocker arm systems.

Conventional stud mount rocker arm systems are economical to produce but due to the point of claiming, are too flexible and weak. Shaft mount rocker systems provide a rigid mount but with the added expense of necessary pillow blocks. More importantly, the shaft mount system adds reciprocating weight to the end of the rocker arm, reciprocating weight being the enemy of valve train lash.

U.S. Pat. No. 5,645,025 ('025 Patent), which issued to Caya et al., discloses an Internal Combustion Engine. The '025 Patent teaches an internal combustion engine comprising a cast cylinder head having as-cast alignment ribs that align a squared-off fulcrum in a rocker assembly. The rocker arm also has two substantially flat surfaces that engage the planar sides of the fulcrum to minimize lateral movement of the rocker arm. The fulcrum is received between the cast alignment ribs. The ribs are biased from a major axis to insure proper fulcrum alignment during assembly without the use of a jig. More particularly, the '025 Patent teaches a rocker arm having a rocker body that rotates around a trunnion. The trunnion slips over a rocker stud. A nut screws onto the rocker stud to hold the rocker assembly in adjustment. This structural assembly is deficient since the clamping point or bending moment is on the bottom side of the nut, which is a distance away from the head casting.

It will thus be seen from an inspection of the foregoing as well as other teachings commonly known in the art that the prior art does not teach an adjustable rocker arm assembly whereby the rocker stud serves as a fixed mount axis about which an adjustment tower may rotate for adjusting the rocker arm assembly and thus providing valve lash adjustment. The prior art thus perceives a need for an adjustable rocker arm assembly whereby the rocker stud functions as a fixed mount axis about which an adjustment tower may rotate for adjusting the rocker arm assembly, thus providing improved valve lash adjustment

SUMMARY OF THE INVENTION

Disclosed is a tubular mount system for a rocker arm which provides a rigid clamp at the base of the engine head without adding an adjuster stud and nut on the rocker arm. Likewise, pillow blocks are not necessary while the device is held together with the strength of a stud. This system results in a rigid clamp without extra reciprocating weight while at the same time, providing ease of valve last adjustment.

Instead of a trunnion simply sliding over a rocker stud, the inside diameter of a trunnion or cross shaft assembly (comprising bearing means) is internally threaded to accept a tubular pedestal mount or adjustment tower (threaded externally) to threadably receive the trunnion or cross shaft assembly. Once threadably assembled, the tubular pedestal mount or adjustment tower receives the rocker stud, the assembly then being held in fixed securement adjacent the engine head by a retaining nut received by the distal end of the rocker stud. The clamping point of the adjustable rocker assembly is thus at the head casting. This structural configuration results in much more stability and durability that prior art configurations. Further, this structural assembly also allows for the valve adjustment to be made without adding an adjuster assembly to the pushrod cup of the rocker arm. This is accomplished by loosening the retaining nut and turning the pedestal mount or adjustment tower (which may be outfitted with a hex at its distal end). Since the tower is always securely clamped to the head casting, when it is turned one way or the other it raises or lowers the centerline of the rocker trunnion or cross shaft, which results in proper valve adjustment. The current invention further allows the engine builder to use different length valves and/or pushrods to change the rocker arm geometry or valve spring harmonics without machining the head or shimming the shaft assembly such as on a shaft style system.

The present invention may further comprise small oiling slots machined into the topside of the trunnions to allow oil a path to flow to the needle bearings. Oil is transferred through the pushrod and squirts out the orifice in the pushrod seat of the rocker. This oil lies on top of the trunnion. The oil slots of the present invention provide oil located in superior adjacency to the trunnion a pathway to lubricate the bearings.

BRIEF DESCRIPTION OF THE DRAWINGS

Other features of my invention will become more evident from a consideration of the following brief description of my patent drawings, as follows:

FIG. 3(*a*) is a top plan view of the tubular pedestal mount of the preferred adjustable rocker arm assembly.

FIG. 3(*b*) is a side plan view of the tubular pedestal mount shown in FIG. 3(*a*).

FIG. 4(*a*) is a top plan view of the cross shaft of the preferred adjustable rocker arm assembly.

FIG. 4(*b*) is an end view of the cross shaft shown in FIG. 4(*a*).

FIG. 5 is a side view of the cross shaft shown in FIG. 4(*a*).

FIG. 6 is an side plan view of an alternative tubular pedestal mount of an alternative adjustable rocker arm assembly.

DETAILED DESCRIPTION OF THE PREFERRED EMBODIMENT(S)

Figure 1:
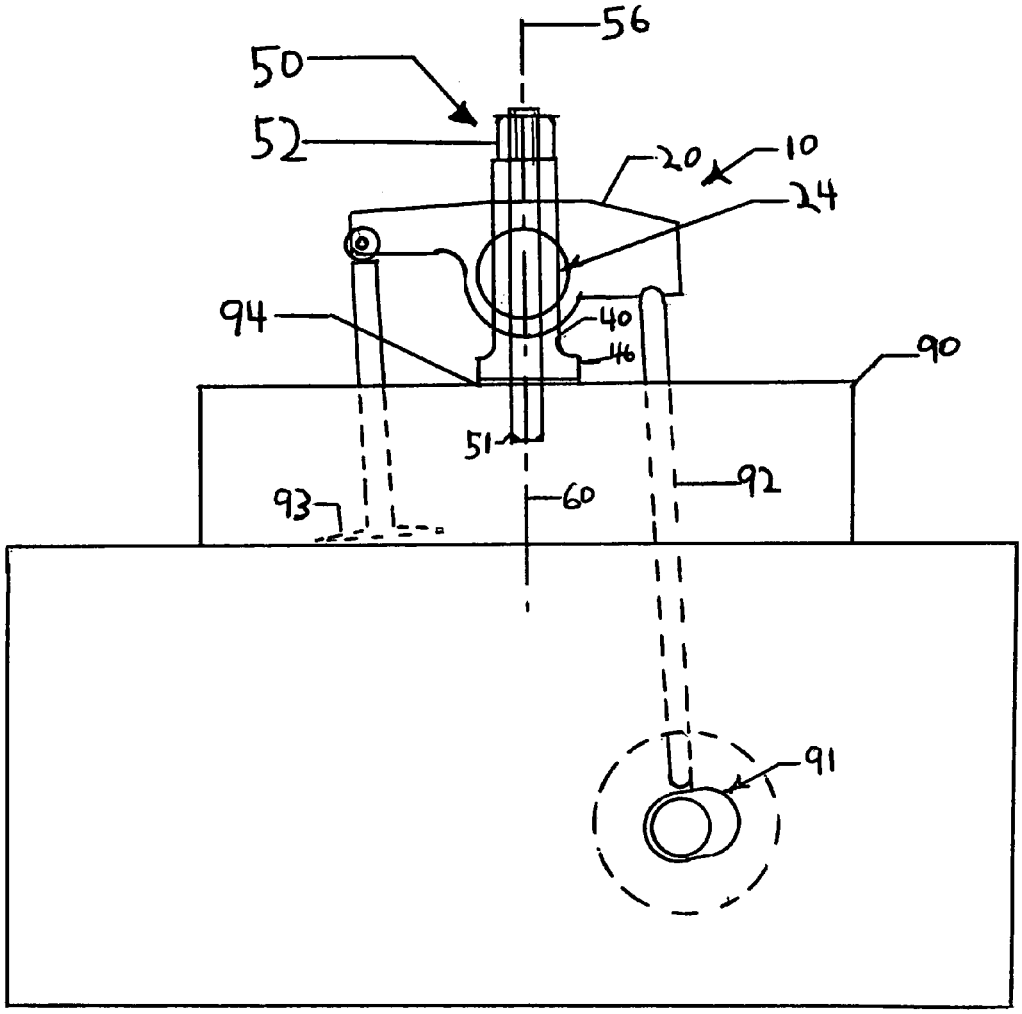
FIG. 1 is a fragmentary side view of a generic internal combustion engine assembly showing a preferred embodiment of the adjustable rocker arm assembly with a trunnion assembly or cross shaft assembly omitted.

Referring now to the drawings, the preferred embodiment of the present invention concerns an internal combustion engine assembly for enabling improved valve lash adjustment. As has been noted hereinabove, valve lash adjustment is often necessary for internal combustion engine assemblies since the most common materials utilized in the construction of internal combustion engines undergo cyclic thermal expansion and are further subject to wear. Accordingly, the valve lash or valve clearance must adjusted periodically to insure more proper function of the internal combustion engine.

Figure 2:
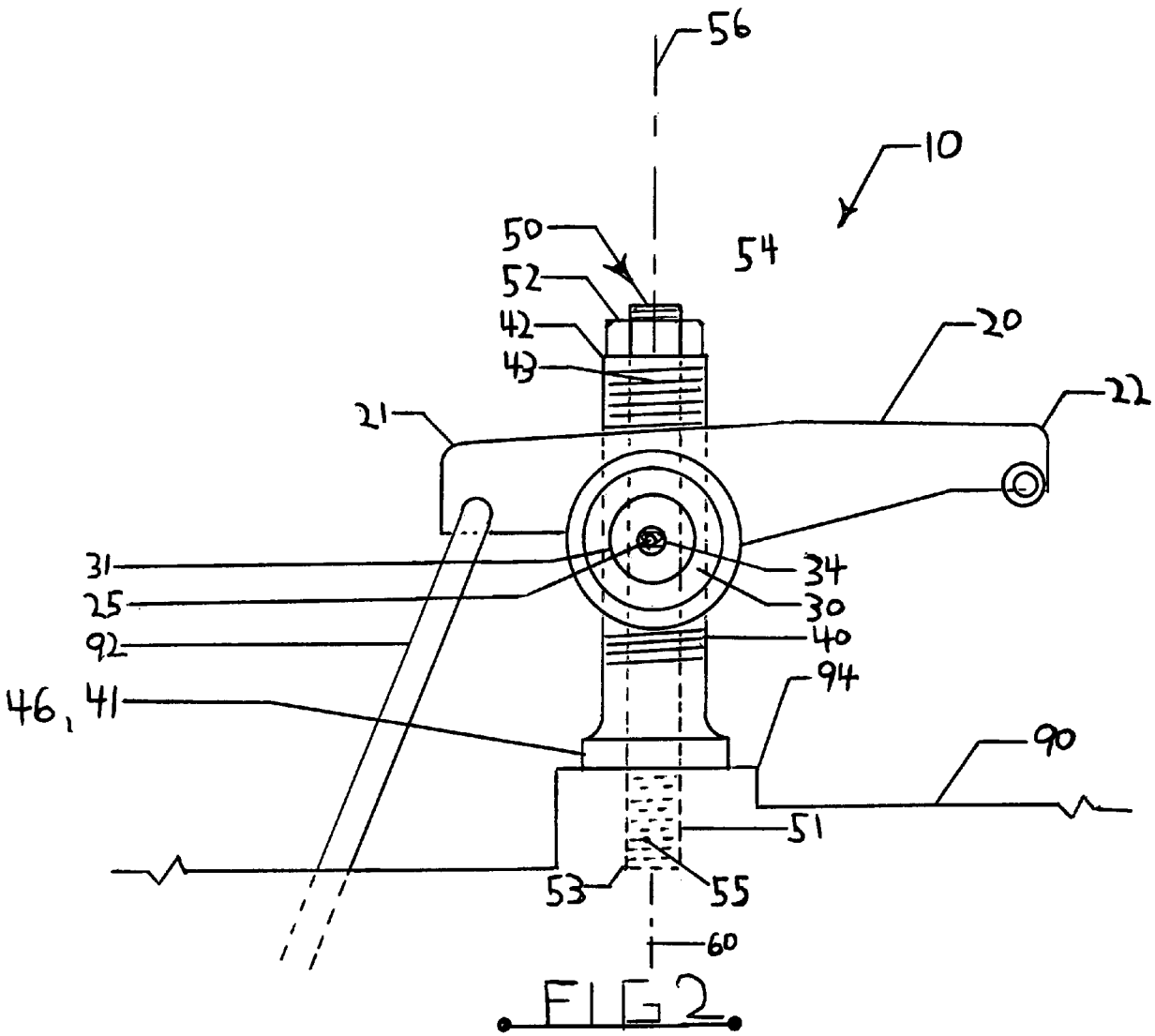
FIG. 2 is a fragmentary side view of the adjustable rocker arm assembly as mounted to a cylinder head of a generic internal combustion engine assembly.

The internal combustion engine assembly of the present invention comprises an adjustable rocker arm assembly 10 as generally illustrated and referenced in FIGS. 1 and 2; an engine head or cylinder head 90 as illustrated and referenced in FIGS. 1 and 2; a camshaft 91 as illustrated and referenced in FIG. 1; a pushrod 92 as illustrated and referenced in FIGS. 1 and 2; and a valve 93 as illustrated and referenced in FIG. 1. As is commonly practiced, camshaft 91 is cooperatively associated with pushrod 92 for imparting motion thereto. In other words as a generic camshaft is rotated, cams integrally formed with the shaft operate to place a generic push rod into motion. It is contemplated that push rod 92 may be viewed as a generic push rod. Engine head or cylinder head 90 preferably comprises a female engine mount 94 as generally illustrated and referenced in FIGS. 1 and 2. Female engine mount 94 preferably comprises right-handed internal mount threads.

Adjustable rocker arm assembly 10 preferably comprises a rocker arm 20 as illustrated and referenced in FIGS. 1 and 2; a cross shaft assembly 30 as illustrated and referenced in FIG. 2; a tubular pedestal mount or adjustment tower or adjustment sleeve 40 as illustrated and referenced in FIGS. 1, 2, 3(*a*), 3(*b*), and 6; and a stud assembly 50 as illustrated and referenced in FIGS. 1 and 2. Stud assembly 50 preferably comprises a rigid rocker stud or stud 51 as further illustrated and referenced in FIGS. 1 and 2; and a retaining nut 52 as illustrated and referenced in FIGS. 1 and 2. Rocker stud or stud 51 preferably comprises a proximal engine end 53 as illustrated and referenced in FIG. 2; a distal stud nut end 54 as illustrated and referenced in FIG. 2; external stud threads 55 as generally illustrated and referenced in FIG. 2; and a stud axis 56 as generally referenced in FIG. 2. Retaining nut 52 preferably comprises internal nut threads and a hex outer surface as may be generally seen from an inspection of FIG. 2. The proximal engine end 53 may thus be threadably received in female engine mount 94, the stud axis 56 thereby being fixed.

Rocker arm 20 preferably comprises a rod end 21 as illustrated and referenced in FIG. 2; a valve end 22 as illustrated and referenced in FIG. 2; a pedestal-stud assembly-receiving gap (not specifically illustrated or referenced); and a shaft-receiving bore 24 as illustrated and referenced in FIG. 1. Shaft-receiving bore 24 inherently has a shaft axis 25 as referenced at a point in FIG. 2 (the axis extending into and out of the page). Cross shaft assembly 30 preferably comprises a cross shaft 31 as illustrated and referenced in FIGS. 2, 4(*a*), 4(*b*), 5, and bearing means (e.g. needle bearings, not specifically referenced). Cross shaft 31 preferably comprises a pedestal-receiving bore 32 as illustrated and referenced in FIGS. 4(*a*), 4(*b*), and 5; bearing lubrication means for lubricating the bearing means during operation of the internal combustion engine assembly; and lock means. The bearing lubrication means may be defined by some form of lubricant (such as oil) and lubricant-receiving slots (not specifically illustrated). The lubricant-receiving slots are preferably formed (machined) into cross shaft 31 in superior adjacency to the bearing means, thereby providing a lubricant conduit to the bearing means. The lubricant, as passed through the lubricant conduit, may thus function to lubricate the bearing means. Pedestal-receiving bore 32 may comprise either right-handed or left-handed internal threads. Preferably, however, pedestal-receiving bore 32 comprises left-handed internal threads.

The lock means may preferably be defined by a set screw assembly cooperatively associated with cross shaft 31. In this regard, the set screw assembly may preferably comprise at least one set screw 34 as illustrated and referenced in FIGS. 2 and 5; and at least one set screw bore 35 formed in cross shaft 31 as illustrated and referenced in FIG. 5 (it will be noted that two set screw bores 35 are depicted in FIG. 5). It is contemplated that each set screw 34 inherently has external screw threads and set screw bore 35 inherently has internal screw threads. Notably, set screw bore 35 has an inherent set axis, which preferably extends orthogonal to or intersects the fixed shaft axis 56. Set screw bore 35 thus threadably receives set screw 34. Pedestal-receiving bore 32 preferably comprises internal bore threads and a bore axis 36 as illustrated and referenced at a point in FIG. 4(*a*) (the axis extending into and out of the page) and in FIGS. 4(*b*) and 5.

Tubular pedestal mount or adjustment tower or adjustment sleeve 40 preferably comprises a proximal head end 41 as illustrated and referenced in FIGS. 2, 3(*a*), 3(*b*), and 6; a distal pedestal nut end 42 as illustrated and referenced in FIGS. 2, 3(*a*), 3(*b*), and 6; external pedestal threads 43 as illustrated and referenced in FIGS. 2, 3(*a*), 3(*b*), and 6: and a stud-recieving bore 44 as illustrated and referenced in FIGS. 3(*a*), 3(*b*), and 6. Notably, external pedestal threads 43 as illustrated in FIGS. 2 and 6 are right-handed threads, and as illustrated in FIG. (3*b*) are left-handed threads. Preferably, external pedestal threads 43 are left-handed threads. Stud-receiving bore 44 inherently has a pedestal axis 45 as referenced at a point in FIG. 3(*a*) and as further referenced in FIGS. 3(*b*) and 6. Stud-receiving bore 44 rotatably receives stud 51, when assembled, and thus tubular or cylindrical pedestal mount 40 is adjustably mounted upon stud 51. In light of fixed stud axis 56 (as previously described), pedestal axis 45 is also preferably fixed after pedestal mount 40 is mounted upon stud 51. In other words, proximal head end 41 thus engages engine head 90 adjacent female engine mount 94 at a pedestal-head interface as may be seen from a general inspection of FIGS. 1 and 2. The otherwise fixed stud axis 56 and fixed pedestal axis 45 are thus preferably collinear and together form a fixed mount axis 60 as generally referenced in FIGS. 1 and 2. Shaft-receiving bore 24 preferably receives cross shaft 31 and shaft 31 is thus mounted within rocker arm 20. Shaft axis 25 and the longitudinal axis of cross shaft 31 thus together form a rocker arm pivot axis (as referenced at 25 in FIG. 2) and the bearing means enable rocker arm 20 to pivot about pivot axis as referenced at 25 in FIG. 2.

It is contemplated that tubular pedestal mount 40 may be further outfitted with set screw-receiving means. It is contemplated that mere frictional engagement between set screw 34 and external pedestal threads 43 may operate to lock cross shaft assembly 30 to tubular pedestal mount 40. However, it is further contemplated that the set screw-receiving means may be further defined by female mount structure 47 as generally illustrated and referenced in FIG. 6. The female mount structure 47 are indentations sized and shaped for receiving the tip of set screw 34 and thus function to selectively and positively lock cross shaft 31 to tubular pedestal mount 40.

Pedestal-receiving bore 32 (preferably comprising left-handed internal threads) threadably receives tubular pedestal mount 40, thereby adjustably mounting cross shaft assembly 30 and rocker arm 20 upon tubular pedestal mount 40. The bore axis and the pivot axis thus become otherwise fixed. The fixed mount axis as referenced at 60 is thus orthogonal to fixed pivot axis as referenced at 25 (in FIG. 2) and is collinear with fixed bore axis as referenced at 60 in FIGS. 1 and 2.

Retaining nut 52 is then threadably received upon distal stud nut end 54, retaining nut 52 thus engaging distal pedestal nut end 42 for selectively securing adjustable rocker arm assembly 10 to engine head 90. Push rod 92 is cooperatively associated with rod end 21 for imparting motion thereto (as initiated by camshaft 91) and valve end 22 is cooperatively associated with valve 93 for imparting motion thereto (as initiated by rocker arm 20). As earlier specified, it is contemplated that the internal combustion engine assembly of the present invention is constructed from thermally expandable, wearable materials and thus requires periodic valve lash adjustment. In this regard, retaining nut 52 is selectively disengageable from distal pedestal nut end 42 for selectively releasing tubular pedestal mount 40 for selective rotational movement. Tubular pedestal mount 40 is thus rotatable about fixed mount axis 60 for providing valve lash adjustment as may be required by the internal combustion engine assembly.

Distal pedestal nut end 42 may preferably comprise means for enhancing rotational movement of tubular pedestal mount 40. In this regard, it is contemplated that the means for enhancing rotational movement of pedestal mount 40 may be defined by distal pedestal nut end 42 comprising a hex configuration for enabling or enhancing rotational movement of tubular pedestal mount 40 about mount axis 60. Further, it is contemplated that proximal head end 41 may preferably comprise means for enhancing stability of tubular pedestal mount 40 at the pedestal-head interface. In this regard, it is contemplated that the means for enhancing the stability of tubular pedestal mount 40 may be defined by an enlarged pedestal base 46 as generally illustrated and referenced in FIGS. 1 and 2, 3(*a*), 3(*b*), and 6. Enlarged pedestal base 46 has an outer basal diameter, the diameter of which is greater in magnitude than the outer diameter of the threaded portions of tubular pedestal mount 40 as may be seen from a general inspection of FIG. 3(*a*). Thus enlarged pedestal base 46 provides adjustable rocker arm assembly 10 with means for means for enhancing the stability of tubular pedestal mount 40 or means for enhancing immobilization of the otherwise fixed mount axis 60.

The present invention thus presents adjustable rocker arm assembly 10 for use in combination with an internal combustion engine, adjustable rocker arm assembly 10 for enabling improved valve lash adjustment. The internal combustion engine will typically comprise an engine head or cylinder head 90, camshaft 91, pushrod 92, and valve 93, camshaft 91 being cooperatively associated with pushrod 92 for imparting motion thereto. Engine head 90 further comprises female engine mount 94, female engine mount 94 having internal mount threads. Adjustable rocker arm assembly 10 comprises rocker arm 20, cross shaft assembly 30, tubular pedestal mount 40, and stud assembly 50. Stud assembly 50 comprises stud 51 and retaining nut 52. Stud 51 comprises engine end 53, stud nut end 51, external stud threads 55, and stud axis 56. Retaining nut comprises internal nut threads. Engine end 53 is threadably receivable in female engine mount 94 and thus stud axis 56 becomes fixed.

Rocker arm 20 comprises rod end 21, valve end 22, a pedestal-stud assembly-receiving gap, and shaft-receiving bore 24, shaft-receiving bore 24 having shaft axis 25. Cross shaft assembly 30 comprises cross shaft 31, bearing means, and lock means (as previously exemplified). Cross shaft 31 comprises pedestal-receiving bore 32, pedestal-receiving bore 32 comprising internal bore threads (left-handed) and bore axis 36. Tubular pedestal mount 40 comprises head end 41, pedestal nut end 42, external pedestal threads 43 (left-handed), and stud-receiving bore 44. Stud-receiving bore 44 has pedestal axis 45. Stud-receiving bore 44 receives stud 51 and tubular pedestal mount 40 is thus mounted upon stud 51.

Pedestal axis 45 thus also becomes fixed. Head end 41 engages engine head 90 at or adjacent to female engine mount 94 at a pedestal-head interface. The fixed stud axis 56 and the fixed pedestal axis 45 are thus collinear and together form fixed mount axis 60. Shaft-receiving bore 24 receives cross shaft 31, cross shaft 31 thus being mounted within rocker arm 20. Shaft axis 25 thus forms a pivot axis and the bearing means enable rocker arm 20 to pivot about the pivot axis.

Pedestal-receiving bore 36 threadably receives tubular pedestal mount 40, cross shaft assembly 30 and rocker arm 20 thereby being adjustably mounted upon tubular pedestal mount 40, the pivot axis thus being fixed. The fixed mount axis 60 is orthogonal to the fixed pivot axis. Retaining nut 52 is threadably received upon stud nut end 54, retaining nut 52 selectively engaging pedestal nut end 42 for selectively securing adjustable rocker arm assembly 10 to engine head 90.

Push rod 92 is cooperatively associated with rod end 21 for imparting motion thereto and valve end 22 is cooperatively associated with valve 93 for imparting motion thereto. The internal combustion engine and adjustable rocker arm assembly 10 are typically constructed from thermally active, wearable materials thus requiring periodic valve lash adjustment. Retaining nut 52 is selectively disengageable from pedestal nut end 42 for selectively releasing tubular pedestal mount 40 for selective rotational movement, tubular pedestal mount 40 thus being rotatable about fixed mount axis 60 for providing improved valve lash adjustment.

An adjustable rocker arm assembly for enabling valve lash adjustment, the adjustable rocker arm assembly comprising a rocker arm, a cross shaft, a pedestal mount, and a stud assembly, the stud assembly comprising a stud and pedestal-retaining means, the stud comprising a stud axis, the stud being mounted to an engine head, the stud axis thus being fixed, the rocker arm comprising a pedestal-stud assembly-receiving gap and a shaft-receiving bore, the shaft-receiving bore having a shaft axis, the cross shaft comprising a pedestal-receiving bore, the pedestal-receiving bore comprising internal bore threads and a bore axis, the pedestal mount comprising a proximal pedestal end, a distal pedestal end, external pedestal threads, and a stud-receiving bore, the stud-receiving bore having a pedestal axis, the stud-receiving bore rotatably receiving the stud, the pedestal mount thus being adjustably mounted upon the stud, the pedestal axis thus being fixed, the proximal pedestal end engaging the engine head, the fixed stud axis and the fixed pedestal axis being collinear thus forming a fixed mount axis, the shaft-receiving bore receiving the cross shaft, the shaft axis and the bore axis being collinear thus forming a pivot axis, the rocker arm being pivotal about the pivot axis, the pedestal-receiving bore threadably receiving the pedestal mount, the cross shaft assembly and the rocker arm thus being adjustably mounted upon the pedestal mount, the pivot axis being fixed, the fixed mount axis being orthogonal to the fixed pivot axis, the pedestal-retaining means releasably securing the adjustable rocker arm assembly to the engine head, the pedestal-retaining means being operable for selectively releasing the pedestal mount for selective rotational movement, the pedestal mount thus being rotatable about the fixed mount axis for providing valve lash adjustment.

While the above description contains much specificity, this specificity should not be construed as limitations on the scope of the invention, but rather as an exemplification of the invention. For example, as is described hereinabove the present invention contemplates an adjustable rocker arm assembly for enabling valve lash adjustment. The adjustable rocker arm assembly essentially comprises a rocker arm, a cross shaft, a pedestal mount, and a stud assembly. The stud assembly comprises a stud and pedestal-retaining means (for example, a retaining nut). The stud comprises a stud axis. The stud is mounted to an engine head and thus the stud axis becomes fixed.

The rocker arm comprises a pedestal-stud assembly-receiving gap and a shaft-receiving bore, the shaft-receiving bore having a shaft axis. The cross shaft comprises a pedestal-receiving bore, the pedestal-receiving bore comprising internal bore threads and a bore axis. The pedestal mount comprises a proximal pedestal end, a distal pedestal end, external pedestal threads, and a stud-receiving bore. The stud-receiving bore has a pedestal axis. The stud-receiving bore rotatably receives the stud and the pedestal mount is adjustably mounted upon the stud. The pedestal axis thus becomes fixed. The proximal pedestal end engages the engine head and the collinear fixed stud and pedestal axes form a fixed mount axis.

The shaft-receiving bore receives the cross shaft, the shaft axis forming a pivot axis. The rocker arm is pivotal about the pivot axis. The pedestal-receiving bore threadably receives the pedestal mount, the cross shaft assembly and the rocker arm thus being adjustably mounted upon the pedestal mount. The pivot axis is then fixed, the fixed mount axis being orthogonal to the fixed pivot axis. The pedestal-retaining means releasably secure the adjustable rocker arm assembly to the engine head. The pedestal-retaining means are operable for selectively releasing the pedestal mount for selective rotational movement, the pedestal mount thus being rotatable about the fixed mount axis for providing valve lash adjustment.

Accordingly, although the invention has been described by reference to a preferred embodiment and at least one alternative embodiment, it is not intended that the novel assembly be limited thereby, but that modifications thereof are intended to be included as falling within the broad scope and spirit of the foregoing disclosure, the following claims and the appended drawings.

I claim:

1. An internal combustion engine assembly for easing valve lash adjustment, the engine assembly comprising an adjustable rocker arm assembly, an engine head, a camshaft, a pushrod, and a valve, the camshaft being cooperatively associated with the pushrod for imparting motion thereto, the engine head comprising a female engine mount, the female engine mount having internal mount threads, the adjustable rocker arm assembly comprising a rocker arm, a cross shaft assembly, a tubular pedestal mount, and a stud assembly, the stud assembly comprising a stud and a retaining nut, the stud comprising an engine end, a stud nut end, external stud threads, and a stud axis, the retaining nut comprising internal nut threads, the engine end being threadably received in the female engine mount, the stud axis thus being fixed, the rocker arm comprising a rod end, a valve end, a pedestal-stud assembly-receiving gap, and a shaft-receiving bore, the shaft-receiving bore having a shaft axis, the cross shaft assembly comprising a cross shaft and bearing means, the cross shaft comprising a pedestal-receiving bore and lock means, the pedestal-receiving bore comprising left-handed internal bore threads and a bore axis, the tubular pedestal mount comprising a head end, a pedestal nut end, left-handed external pedestal threads, and a stud-receiving bore, the stud-receiving bore having a pedestal axis, the stud-receiving bore rotatably receiving the stud, the tubular pedestal mount thus being adjustably mounted upon the stud, the pedestal axis thus being fixed, the head end engaging the engine head adjacent the female engine mount at a pedestal-head interface, the fixed stud axis and the fixed pedestal axis being collinear thus forming a fixed mount axis, the shaft-receiving bore receiving the cross shaft, the cross shaft thus being mounted within the rocker arm, the shaft axis thus forming a pivot axis, the bearing means enabling the rocker arm to pivot about the pivot axis, the pedestal-receiving bore threadably receiving the tubular pedestal mount, the cross shaft assembly and the rocker arm thus being adjustably mounted upon the tubular pedestal mount, the bore axis and the pivot axis thus each being fixed, the fixed mount axis being orthogonal to the fixed pivot axis and collinear with the fixed bore axis, the retaining nut being threadably received upon the stud nut end, the retaining nut engaging the pedestal nut end for selectively securing the adjustable rocker arm assembly to the engine head, the push rod being cooperatively associated with the rod end for imparting motion thereto, the valve end being cooperatively associated with the valve for imparting motion thereto, the engine assembly being constructed from thermally expandable, wearable materials, the engine assembly thus requiring periodic valve lash adjustment, the retaining nut being selectively disengageable from the pedestal nut end for selectively releasing the tubular pedestal mount for selective rotational movement, the tubular pedestal mount being rotatable about the fixed mount axis for providing eased valve lash adjustment.

2. The internal combustion engine assembly of claim 1 wherein the head end comprises means for enhancing stability of the tubular pedestal mount at the pedestal-head interface.

3. The internal combustion engine assembly of claim 2 wherein the means for enhancing the stability of the tubular pedestal mount is defined by an enlarged pedestal base.

4. The internal combustion engine assembly of claim 3 wherein the pedestal nut end comprises means for enhancing rotational movement of the tubular pedestal mount.

5. The internal combustion engine assembly of claim 4 wherein the cross shaft assembly comprises bearing lubrication means for lubricating the bearing means during operation of the internal combustion assembly.

6. The internal combustion engine assembly of claim 5 wherein the bearing lubrication means is defined by lubricant and lubricant-receiving slots, the lubricant-receiving slots being formed in the cross shaft in superior adjacency to the bearing means, the lubricant-receiving slots providing a lubricant conduit to the bearing means, the lubricant lubricating the bearing means.

7. The internal combustion engine assembly of claim 6 wherein the lock means are defined by a set screw assembly, the set screw assembly comprising at least one set screw and at least one set screw bore formed in the cross shaft, the set screw having external screw threads, the set screw bore having internal screw threads, the set screw bore having a set axis extending orthogonal to the mount axis, the set screw bore threadably receiving the set screw, the external pedestal threads comprising set screw-receiving means, the set screw-receiving means for receiving the set screw for locking the cross shaft to the tubular pedestal mount.

8. The internal combustion engine assembly of claim 7 wherein the set screw-receiving means are defined by female mount structure, the female mount structure for selectively and positively locking the cross shaft to the tubular pedestal mount.

9. An adjustable rocker arm assembly for use in combination with an internal combustion engine, the adjustable rocker arm assembly for easing valve lash adjustment, the internal combustion engine comprising an engine head, a camshaft, a pushrod, and a valve, the camshaft being cooperatively associated with the pushrod for imparting motion thereto, the engine head comprising a female engine mount, the female engine mount having internal mount threads, the adjustable rocker arm assembly comprising:

a rocker arm, a cross shaft assembly, a tubular pedestal mount, and a stud assembly, the stud assembly comprising a stud and a retaining nut, the stud comprising an engine end, a stud nut end, external stud threads, and a stud axis, the retaining nut comprising internal nut threads, the engine end being threadably received in the female engine mount, the stud axis thus being fixed, the rocker arm comprising a rod end, a valve end, a pedestal-stud assembly-receiving gap, and a shaft-receiving bore, the shaft-receiving bore having a shaft axis, the cross shaft assembly comprising a cross shaft, bearing means, and lock means, the cross shaft comprising a pedestal-receiving bore, the pedestal-receiving bore comprising internal bore threads, the tubular pedestal mount comprising a head end, a pedestal nut end, external pedestal threads, and a stud-receiving bore, the stud-receiving bore having a pedestal axis, the stud-receiving bore receiving the stud, the tubular pedestal mount thus being mounted upon the stud, the pedestal axis thus being fixed, the head end engaging the engine head adjacent the female engine mount at a pedestal-head interface, the fixed stud axis and the fixed pedestal axis being collinear thus forming a fixed mount axis, the shaft-receiving bore receiving the cross shaft, the cross shaft thus being mounted within the rocker arm, the shaft axis thus forming a pivot axis, the bearing means enabling the rocker arm to pivot about the pivot axis, the pedestal-receiving bore threadably receiving the tubular pedestal mount, the cross shaft assembly and the rocker arm thus being adjustably mounted upon the tubular pedestal mount, the pivot axis being fixed, the fixed mount axis being orthogonal to the fixed pivot axis, the retaining nut being threadably received upon the stud nut end, the retaining nut selectively engaging the pedestal nut end for selectively securing the adjustable rocker arm assembly to the engine head, the push rod being cooperatively associated with the rod end for imparting motion thereto, the valve end being cooperatively associated with the valve for imparting motion thereto, the internal combustion engine and the adjustable rocker arm assembly being constructed from thermally expandable, wearable materials thus requiring periodic valve lash adjustment, the retaining nut being selectively disengageable from the pedestal nut end for selectively releasing the tubular pedestal mount for selective rotational movement, the tubular pedestal mount thus being rotatable about the fixed mount axis for providing eased valve lash adjustment.

10. The adjustable rocker arm assembly of claim 9 wherein the head end comprises means for enhancing stability of the tubular pedestal mount at the pedestal-head interface.

11. The adjustable rocker arm assembly of claim 9 wherein the pedestal nut end comprises means for enhancing rotational movement of the tubular pedestal mount.

12. The adjustable rocker arm assembly of claim 9 wherein the cross shaft assembly comprises bearing lubrication means for lubricating the bearing means during operation of the internal combustion assembly.

13. The adjustable rocker arm assembly of claim 10 wherein the means for enhancing the stability of the tubular pedestal mount is defined by an enlarged pedestal base.

14. The adjustable rocker arm assembly of claim 9 wherein the lock means are defined by a set screw assembly, the set screw assembly comprising at least one set screw and at least one set screw bore formed in the cross shaft, the set screw having external screw threads, the set screw bore having internal screw threads, having external screw threads, the set screw bore having internal screw threads, the set screw bore having a set axis intersecting the mount axis, the set screw bore threadably receiving the set screw, the external pedestal threads comprising set screw-receiving means, the set screw-receiving means for receiving the set screw for locking the cross shaft to the tubular pedestal mount.

15. The adjustable rocker arm assembly of claim 14 wherein the set screw-receiving means are defined by female mount structure, the female mount structure for selectively and positively locking the cross shaft to the tubular pedestal mount.

16. An adjustable rocker arm assembly for easing valve lash adjustment, the adjustable rocker arm assembly comprising a rocker arm, a cross shaft, a pedestal mount, and a stud assembly, the stud assembly comprising a stud and pedestal-retaining means, the stud comprising a stud axis, the stud being mounted to an engine head, the stud axis thus being fixed, the rocker arm comprising a shaft-receiving bore, the shaft-receiving bore having a shaft axis, the cross shaft comprising a pedestal-receiving bore, the pedestal-receiving bore comprising internal bore threads, the pedestal mount comprising a proximal pedestal end, a distal pedestal end, external pedestal threads, and a stud-receiving bore, the stud-receiving bore having a pedestal axis, the stud-receiving bore rotatably receiving the stud, the pedestal mount thus being adjustably mounted upon the stud, the pedestal axis thus being fixed, the proximal pedestal end engaging the engine head, the fixed stud axis and the fixed pedestal axis being collinear thus forming a fixed mount axis, the shaft-receiving bore receiving the cross shaft, the shaft axis thus forming a pivot axis, the rocker arm being pivotal about the pivot axis, the pedestal-receiving bore threadably receiving the pedestal mount, the cross shaft assembly and the rocker arm thus being adjustably mounted upon the pedestal mount, the pivot axis being fixed, the fixed mount axis being orthogonal to the fixed pivot axis, the pedestal-retaining means releasably securing the adjustable rocker arm assembly to the engine head, the pedestal-retaining means being operable for selectively releasing the pedestal mount for selective rotational movement, the pedestal mount thus being rotatable about the fixed mount axis for providing eased valve lash adjustment.

17. The adjustable rocker arm assembly of claim 16 wherein the pedestal mount comprises means for enhancing immobilization of the fixed stud axis.

18. The adjustable rocker arm assembly of claim 16 wherein the pedestal mount comprises means for enhancing rotational movement of the pedestal mount.

19. The adjustable rocker arm assembly of claim 16 comprising lock means for locking the cross shaft to the pedestal mount.

20. The adjustable rocker arm assembly of claim 16 wherein the cross shaft comprises bearing-lubrication means and bearing means, the bearing lubrication means for lubricating the bearing means.

* * * * *